US009956702B2

(12) United States Patent
Bolander et al.

(10) Patent No.: US 9,956,702 B2
(45) Date of Patent: May 1, 2018

(54) METHOD AND DEVICE FOR MANUFACTURING A CUTTING INSERT GREEN BODY

(71) Applicant: SANDVIK INTELLECTUAL PROPERTY AB, Sandviken (SE)

(72) Inventors: Christer Bolander, Valbo (SE); Per Lindskog, Alvsjo (SE); Johan Larsson, Sandviken (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days. days.

(21) Appl. No.: 14/901,132

(22) PCT Filed: Jul. 4, 2014

(86) PCT No.: PCT/EP2014/064297

§ 371 (c)(1),
(2) Date: Dec. 28, 2015

(87) PCT Pub. No.: WO2015/001075

PCT Pub. Date: Jan. 8, 2015

(65) Prior Publication Data

US 2016/0121516 A1 May 5, 2016

(30) Foreign Application Priority Data

Jul. 5, 2013 (EP) ..... 13175352

(51) Int. Cl.
*B28B 3/08* (2006.01)
*B22F 3/03* (2006.01)
(Continued)

(52) U.S. Cl.
CPC ..... *B28B 3/086* (2013.01); *B22F 3/02* (2013.01); *B22F 3/03* (2013.01); *B22F 5/10* (2013.01);
(Continued)

(58) Field of Classification Search
None
See application file for complete search history.

(56) References Cited

U.S. PATENT DOCUMENTS 4,298,563 A 11/1981 Desantis et al.
6,099,772 A * 8/2000 Hinzmann ..... B22F 3/03 264/109

(Continued)

FOREIGN PATENT DOCUMENTS

DE 10311841 A1 8/2004
WO 98/26188 6/1998

*Primary Examiner* — Mary Lynn F Theisen
(74) *Attorney, Agent, or Firm* — Corinne R. Gorski

(57) ABSTRACT

A method and device for manufacturing a cutting insert green body, the method includes the step of providing a compression tool having an upper and lower die, and an upper and lower punch. The upper die defines a punch tunnel in which the upper punch slides, and the lower die defines a punch tunnel in which the lower punch slides. The dies define a die cavity to accommodate a powder to be compressed by action of the respective punches to form the green body. Powder in the die cavity is compressed by forwarding the upper punch through the punch tunnel of the upper die and a predetermined distance L through the opening of the lower die. The upper die is displaced relative to the opening of the lower die and the upper punch is removed from the lower die to move the green body out of the lower die through the opening thereof.

12 Claims, 4 Drawing Sheets

(51) Int. Cl.

| | |
|---|---|
| ***B30B 11/02*** | (2006.01) |
| ***B30B 15/02*** | (2006.01) |
| ***B22F 5/10*** | (2006.01) |
| ***B22F 3/02*** | (2006.01) |
| ***B28B 7/10*** | (2006.01) |
| *B22F 5/00* | (2006.01) |

(52) U.S. Cl.
CPC ..... *B28B 7/10* (2013.01); *B30B 11/027* (2013.01); *B30B 15/022* (2013.01); *B22F 2005/001* (2013.01)

(56) References Cited

U.S. PATENT DOCUMENTS

| | | | | |
|---|---|---|---|---|
| 6,325,545 | B1 | 12/2001 | Strangl et al. | |
| 6,365,094 | B1 | 4/2002 | Hinzmann et al. | |
| 7,235,201 | B2 * | 6/2007 | Hicklen ..... | B22F 3/03 264/109 |
| 2004/0035967 | A1 | 2/2004 | Johnson et al. | |
| 2004/0197219 | A1 | 10/2004 | Degen et al. | |
| 2006/0165828 | A1 | 7/2006 | Smilovici | |
| 2012/0107444 | A1 * | 5/2012 | Murasugi ..... | B22F 3/03 425/551 |
| 2012/0319328 | A1 * | 12/2012 | Ando ..... | A61J 3/10 264/319 |

* cited by examiner

METHOD AND DEVICE FOR MANUFACTURING A CUTTING INSERT GREEN BODY

RELATED APPLICATION DATA

This application is a § 371 National Stage Application of PCT International Application No. PCT/EP 2014/064297 filed Jul. 4, 2014 claiming priority of EP Application No. 13175352.7, filed Jul. 5, 2013.

TECHNICAL FIELD

The present invention relates to a method and device for manufacturing a cutting insert green body by compressing a powder.

The invention relates to the technical field in which cutting inserts, preferably to be used for the machining of metal by milling, drilling or turning or by similar chip forming methods, are produced from a powder which is compressed to a green body and then subjected to a sintering stage in which the body is further densified.

BACKGROUND OF THE INVENTION

In connection to the compressing of a powder to a green body during production of cutting inserts, the powder is introduced into a cavity defined by a die. Normally, the die comprises an upper opening through which the powder is introduced into said cavity and through which, during a subsequent pressing step, an upper punch is introduced into the die. Typically, there is also provided a lower punch which is able of sliding through a tunnel in the die and which will form at least part of a bottom of said die cavity and by means of which the green body formed upon compression of the powder is ejected from the surrounding die. From the upper opening of the die there is provided a punch tunnel in which the upper punch is able to move downwards for the purpose of contacting the powder and subjecting it to a compacting pressure. In other words, the punch tunnels define the die cavity provided for receipt of the powder, and the punches are provided for the purpose of compacting a powder received in said cavity.

After compaction of the powder to a green body, the upper punch is retracted out of the die, and the green body is ejected by a motion of the lower punch relative to the die (either of these components could be the one which is moving). Accordingly, the green body is ejected through the tunnel in which the upper punch was moving downwards into the die during the pressing step.

Typically, the material of the green body is of such nature that it will expand when ejected and released from the surrounding die. In order to enable the green body to expand radially when it is ejected from the cavity in which it has been compressed, the tunnel is widened slightly above the level to which the upper punch is forwarded during compaction. It could be said that the cavity is provided with a release portion having a certain inclination angle of the inner wall of the die relative a centre axis of the cavity. The inclination angle (possibly also referred to as the release angle), as well as the length (in the vertical direction) of the release portion is adapted to the expected (radial) expansion of the green body upon ejection thereof.

Typically, the cavity has a cross section that narrows as seen from the release portion to the remaining (lower) part of the cavity. Upon compression of the powder, a lower edge of the upper punch, which is defined by the intersection of a lateral surface and a bottom surface thereof, is not allowed to come into contact with the inner peripheral surface of the die, since such contact might result in damages on both die and punch. Therefore, the punch is only forwarded to a level at which there will be a small gap between said punch edge and the inner peripheral surface of the die. During compaction of the powder, the latter will be able of leaking out through said gap and into the release portion. Such leakage will result in a residual edge being formed on the green body along the upper edge thereof, which needs to be treated, i.e. removed, before the subsequent sintering of the green body. Such treatment is time-consuming and contributes to unwanted production costs. The leakage also results in unwanted loss of material. Further negative effects of powder leakage may also be an unwanted effect on the shape of the upper edge of the green body or a lower density, i.e. a generation of porosity, in the region of the upper edge of the green body.

THE OBJECT OF THE INVENTION

It is an object of the present invention to present a method and a device by means of which a residual edge formed on the cutting insert green body in the region thereof where an upper punch acts on the green body during the pressing thereof is reduced in relation to prior art.

It is also an object of the invention to present a method and device by means of which further negative effects of powder leakage, such as generation of porosity in the green body in the region of the upper edge thereof or deformation of the upper edge thereof, may be reduced in relation to prior art.

SUMMARY OF THE INVENTION

The object of the invention is achieved by means of a method for manufacturing a cutting insert green body by compressing a powder, comprising the steps of: providing a compression tool comprising an upper die and a lower die, an upper punch and a lower punch, wherein the upper die defines a punch tunnel in which the upper punch is able to slide, and the lower die defines a punch tunnel in which the lower punch is able to slide, and wherein the dies, when joined, together define a die cavity provided to accommodate a powder to be compressed by action of the respective punches for the forming of said green body; providing the lower punch in a predetermined position in the punch tunnel of the lower die; filling powder into an open cavity defined in the lower die; joining the upper and lower dies such that an opening of the upper die meets and communicates with a corresponding opening of the lower die and such that said cavity filled with powder in the lower die forms part of said die cavity; compressing the powder in said die cavity by action of said punches, whereby said upper punch is forwarded through the punch tunnel of the upper die and is forwarded a predetermined distance L through said opening of the lower die and into the lower die, whereby said green body is formed; displacing the upper die relative the opening of the lower die, thereby providing for more space for the green body to exit through; and removing the upper punch from the lower die, and moving the green body out of the lower die through said opening of the lower die. For the sake of clarity it should be mentioned that the punch tunnels define the die cavity provided to accommodate the powder, and the punches are provided for the purpose of compacting a powder accommodated in said cavity. The powder in the die cavity may be compressed by means of forwarding the upper punch towards the lower punch or by means of forwarding both punches towards each other.

The object of the invention is achieved thanks to the subdivision of the die into an upper die and a lower die. Since the upper die is to be removed before ejection of the green body, there is less need of a release portion above the level to which the lower edge of the upper punch is forwarded during the pressing step. There will still be a release portion just above said level, but that portion may be very much reduced compared to the release portion needed if a single die is used. Due to the reduction of the release portion, the residual edge formed on the green body by powder that has escaped into the release portion during the pressing step is reduced.

It should be understood that more than one upper punch and more than one lower punch may be provided, and that such designs will still be within the claimed scope of protection. The upper die may also be subdivided in two or more parts that may be movable in relation to each other, in particular for the purpose of displacing the upper die relative the lower die before ejection of the green body.

Preferably, the die cavity defined by the dies has a vertical centre axis and, in the region of said opening of the lower die, an inner peripheral surface of the lower die has an inclination angle $\alpha$ relative said centre axis such that an inner circumference of the inner peripheral surface of the lower die increases towards said opening thereof. The inclination angle may be different for different regions of said inner peripheral surface in said region of said opening. For example, in the uppermost region of said peripheral surface, said inclination may be less than in the adjacent lower region of said peripheral surface, such that it is zero or close to zero. Said centre axis is also the centre axis of the respective punch tunnel, and will thus preferably also be the centre axis of the respective punch provided in said punch tunnels. Preferably, the inclined inner peripheral surface extends such that it intersects with (i.e. meets) an upper surface of the lower die and forms an edge at said intersection. The vertical extension of the inclined peripheral surface, as seen from the level in the cavity to which the lower edge of the upper punch is forwarded during the pressing step and upwards, may be very short, since the removable upper die will be displaceable relative the lower die, and will guarantee that, upon removal thereof, there will be enough space for the green body to expand when ejected. The inclination angle of the inner peripheral surface of the lower die in said region of the opening thereof may preferably be the same angle as an inclination angle of the inner peripheral surface of a part of the cavity in which the green body is finally formed. In other words, the inner peripheral surface of the lower die in said region of the opening thereof may form a continuation of said part of the cavity in which the green body is finally formed, with the same inclination angle of the inner peripheral surface of the lower die. The part of the inner peripheral surface of the lower die that will be above the level to which the lower edge of the upper punch is forwarded during the pressing step may be regarded as a release portion for the green body, though a very short one compared to prior art.

According to a preferred embodiment of the invention, the opening of the upper die is smaller than the opening of the lower die, such that the upper die overlaps the opening of the lower die with a distance l when the dies are joined. The overlap of the upper die will contribute to the delimitation of a space into which powder may escape through the gap between the lower edge of the upper punch and the inner peripheral surface of the lower die during the pressing step. Said space is delimited by the inner peripheral surface of the lower die, the outer peripheral (lateral) surface of the upper punch and a lower surface of the upper die that overlaps the opening of the lower die and extends towards the outer peripheral (lateral) surface of the upper punch. If more than one upper punch is provided, said space may be delimited also by peripheral surfaces of such further upper punches. Preferably, $l \leq 55$ μm.

According to a preferred embodiment, the upper punch presents an abutment surface for abutment against the powder, an outer peripheral surface, and a punch edge at an intersection between the abutment surface and the outer peripheral surface, and the upper punch is forwarded such a distance L into the lower die that there is a remaining gap g between said inner peripheral surface of the lower die and said punch edge. The gap g should be small enough to minimize the formation of a residual edge as a result of powder escaping through it during the pressing step. Preferably, the gap is of the same size along the circumference of the punch (or punches if the upper punch is subdivided in several punches). The distance L is the distance in a vertical direction from the punch edge to an upper peripheral surface of the lower die at said opening thereof, when the upper punch has been forwarded to the final pressing position in the lower die. When the upper punch is forwarded the distance L into the lower die, the level of the punch edge will define an upper edge of the green body that is compressed. In other words, the cavity which will define the shape of the compressed green body is defined by the lower die, the lower punch and the upper punch forwarded into the lower die. A release portion, i.e. a space not occupied by the green body, is present in the lower die above the level to which the punch edge of the upper punch is forwarded during compaction.

According to a preferred embodiment, in the region of the opening of the upper die, there is a gap k between an outer peripheral surface of the upper punch and an inner peripheral surface of the upper die, wherein $k<50$ μm, preferably $k<30$ μm, more preferably $k<15$ μm, and most preferably $k<10$ μm. The gap k may differ along the circumference of the upper punch but is preferably essentially the same around the latter, depending on the geometry of the die cavity, the geometry of the upper punch and the positioning of the upper punch. A small gap k will prevent powder from leaking out from the above-mentioned space into the gap k between the outer peripheral surface of the upper punch and the inner peripheral surface of the upper die. Preferably, $l+k \leq 55$ μm, or more preferably $l+k \leq 35$ μm, or even more preferably $l+k \leq 20$ μm.

L is dependent on the geometry of the green body to be produced. However, the principle of the invention enables a relatively short L to be applied, and thereby a relatively small space to be defined, into which powder may escape and form a residual edge on the green body. However, L should not be too short. According to a preferred embodiment, $L \geq 50$ μm.

Preferably, $2° \leq \alpha \leq 30°$. Such an inclination angle will be suitable and preferred for the green body geometries and powders that are conceived.

Preferably, 0 μm$<g\leq$30 μm and even more preferably 5 μm$<g\leq$30 μm. Possibly, 5 μm$<g\leq$20 μm. It is essential that the punch edge is not allowed to get into contact with the inner peripheral surface of the lower die. It is also essential that the gap g is as small as possible in order to prevent excessive amounts of powder from escaping through said gap.

After compression of the powder by means of the respective upper and lower punches, such that a green body has been formed in said die cavity, the green body is moved out of the lower die either by withdrawal of the lower die while the lower punch is maintained in its position, or by ejection of the lower punch through the lower die while the latter is maintained in its position, or a combination thereof. Irrespective of which principle that is used, the green body is ejected through said opening of the lower die.

The object of the invention is also achieved by means of a device for manufacturing a cutting insert green body by compressing a powder, said device comprising; a compression tool comprising an upper die and a lower die, an upper punch and a lower punch, wherein the upper die defines a punch tunnel in which the upper punch is able to slide, and the lower die defines a punch tunnel in which the lower punch is able to slide, and wherein the dies, when joined, together define a die cavity provided to accommodate a powder to be compressed by action of the respective punches for the forming of said green body, whereby the upper and lower dies are provided with a respective opening such that an opening of the upper die meets and communicates with a corresponding opening of the lower die when the upper and lower dies are joined, whereby the upper punch is arranged so as to be forwarded a predetermined distance L through said opening of the lower die and into the lower die upon compaction of the powder, and whereby the upper die is displaceable relative the opening of the lower die, and is arranged so as to be displaced relative said opening of the lower die before removal of said green body through said opening of the lower die, thereby providing for more space for the green body to exit through.

Preferably, the die cavity defined by the dies has a vertical centre axis (the centre axis of said punch tunnels) and, in the region of said opening of the lower die, an inner peripheral surface of the lower die has an inclination angle $\alpha$ relative said centre axis such that an inner circumference of the inner peripheral surface of the lower die increases towards said opening thereof. Above the level to which a punch edge of the upper punch is arranged to be forwarded during pressing of the green body, the inner peripheral surface of the lower die preferably has said inclination, preferably up to a level where said inner peripheral surface intersects, i.e. meets, the plane of an upper surface of the lower die and forms an edge with the latter. Thereby, an opening for the entry of the upper punch is presented and there is provided a release portion for the release of the green body in connection to the ejection thereof through said opening of the lower die.

Preferably, the opening of the upper die is smaller than the opening of the lower die, such that the upper die overlaps the opening of the lower die with a distance l when the dies are joined. An inner peripheral surface of the upper die defines the punch tunnel therein. A lower peripheral surface of the upper die, which will abut an opposite upper peripheral surface of the lower die when the dies are joined, meets the inner peripheral surface of the upper die and forms an edge therewith. At least in the region of said edge, the overlap of the upper die relative the opening of the lower die should be such that a gap k between the inner peripheral surface of the upper die and the outer, lateral peripheral surface of the upper punch is small enough to prevent leakage of powder through it in connection to the pressing of the powder in the die cavity to the green body. As mentioned earlier, $k<50$ μm, preferably $k<30$ μm, more preferably $k<15$ μm, and most preferably $k<10$ μm. Preferably, said region in which the gap k exists, and fulfils the above-mentioned requisite, extends in the vertical direction, along the punch tunnel of the upper die, and is not restricted only to said edge of the upper die.

According to a preferred embodiment, the upper punch presents an abutment surface for abutment against the powder, an outer peripheral surface, and a punch edge at an intersection between the abutment surface and the outer peripheral surface, wherein the upper punch is arranged to be forwarded such a distance L into the lower die that there is a remaining gap g between said inner peripheral surface of the lower die and said punch edge. Depending on the geometry of the conceived green body, reflected by the geometry of the die cavity and the shape of the respective punches, g may differ along the circumference of the upper punch. For example, the edge may have a wave-like shape, which will result in some sections with larger gap g and some sections with smaller gap g along the circumference of the upper punch. However, it is preferred that g is kept constant along the circumference of the upper punch and that, in cases in which the edge has a wave-like shape, l and L are permitted to vary in accordance with the irregular shape of the edge.

Preferably, $l\leq55$ μm. Preferably, $l+k\leq55$ μm, or more preferably $l+k\leq35$ μm, or even more preferably $l+k\leq20$ μm. The larger the overlap l, the larger will the space be that is defined by the lower peripheral surface of the upper die, the outer peripheral surface of the upper punch and the inclined inner peripheral surface of the lower die above the level to which the punch edge of the upper punch is forwarded during the pressing of the powder. In other words, if l is large, the space into which powder will escape through the gap g and form a residual edge on the green body will be large. Therefore it is preferred to keep l relatively small, as well as L.

Preferably, $L\geq50$ μm, and, preferably, $2°\leq\alpha\leq30°$. It is also preferred that 0 μm$<g\leq30$ μm. Thereby, the above-mentioned space into which powder will escape during pressing will be relatively small, and the opening of the lower die will enable the upper punch to move through it and into the lower die.

Further features and advantages of the present invention will be presented in the following detailed description of an embodiment thereof.

BRIEF DESCRIPTION OF THE DRAWINGS

Hereinafter, an embodiment of the present invention will be presented with reference to the annexed drawing, on which.

DETAILED DESCRIPTION OF THE INVENTION

FIGS. 1-6 show different steps during forming of a cutting insert green body by means of a device according to the present invention. The cutting insert green body is formed from a powder which is compacted by means of the device and method of the invention. The powder may be any powder suitable for such production, for example a powder used for making cemented carbide, ceramic or cermet bodies. The cutting insert to be produced is aimed for the machining of metal by milling, drilling or turning or by similar chip forming methods. After forming of the green body, the latter is preferably sintered to its final shape in accordance with suitable contemporary technique and, normally, provided with a suitable wear resistant coating comprising single or multiple layers of, for example, at least one carbide, nitride, carbonitride, oxide or boride with any suitable contemporary technique, such as physical vapour deposition or chemical vapour deposition.

Figure 1:
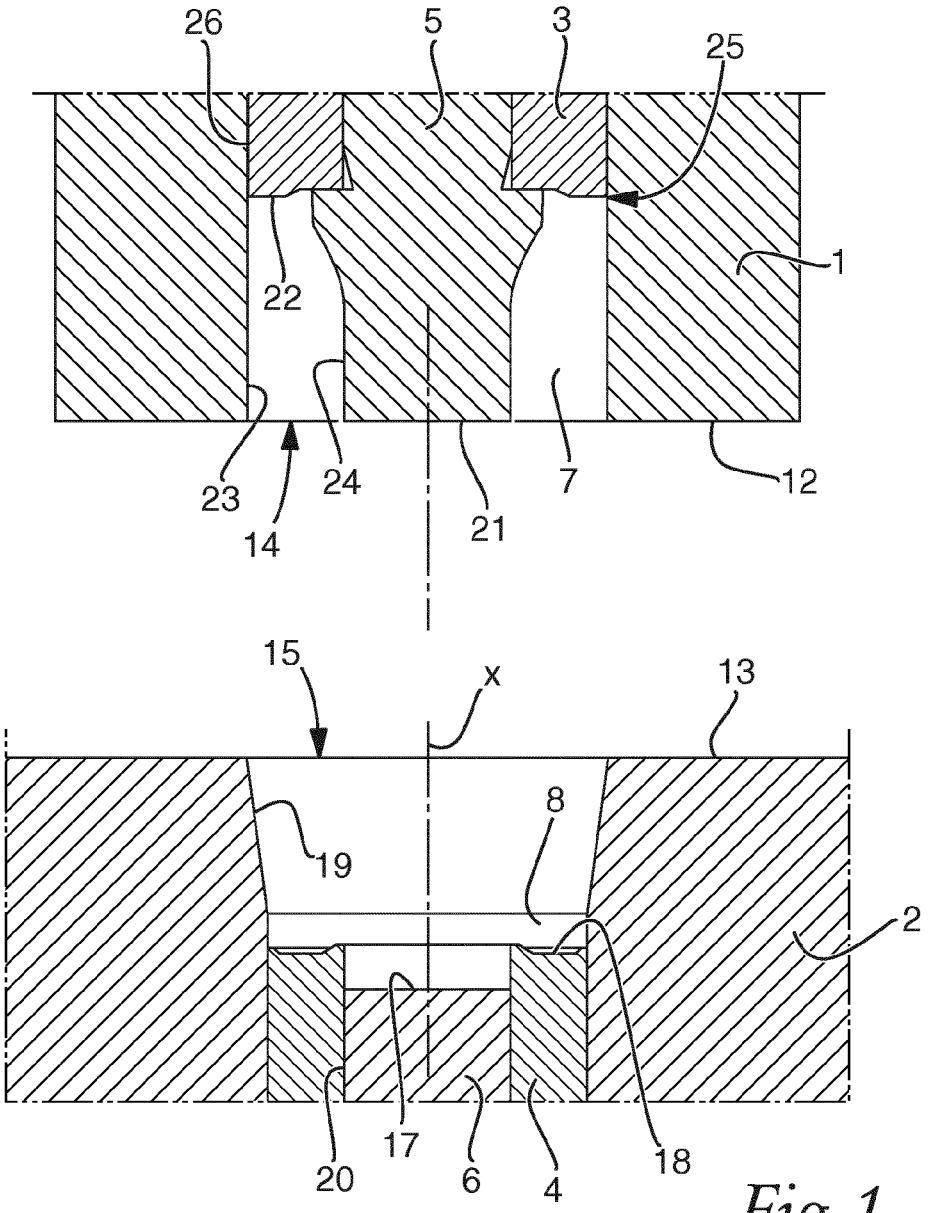
FIG. 1 is a cross section of a device according to the invention before a filling step in which a powder is introduced into a die cavity thereof.

FIG. 1 shows the principal components of the device according to the invention, in a position before a filling step in which a powder is introduced into a die cavity thereof. The device comprises an upper die 1, a lower die 2, an upper punch 3 and a lower punch 4. There is also provided an upper core pin 5 and a lower core pin 6.

The upper die 1 defines a punch tunnel 7 in which the upper punch 3 is able to slide in a vertical direction (given that the device is positioned as suggested in the room). The lower die 2 defines a punch tunnel 8 in which the lower punch 4 is able to slide in a vertical direction. Though not shown in the figures, it should be understood that to the respective punches 3, 4 there is connected a respective driving device for the driving of each punch 3, 4 in its respective punch tunnel such that the respective punch 3, 4 slides therein in the vertical direction. In the embodiment shown, the upper punch 3 is fixed to the upper core pin 5, such that these components will move together as one unit. The lower core pin 6, on the other hand, which is arranged in a tunnel in the lower punch 4, is movable in a vertical direction in relation to the lower punch 4 and is separately driven with regard to the latter. The core pins 5, 6 are provided for the purpose of generating a centre hole in the cutting insert green body to be produced by means of the device. It should be understood that embodiments that do not include core pins or in which core pins are differently arranged and driven with regard to the remaining components of the device are also conceived and fully possible within the scope of the present invention.

Figure 2:
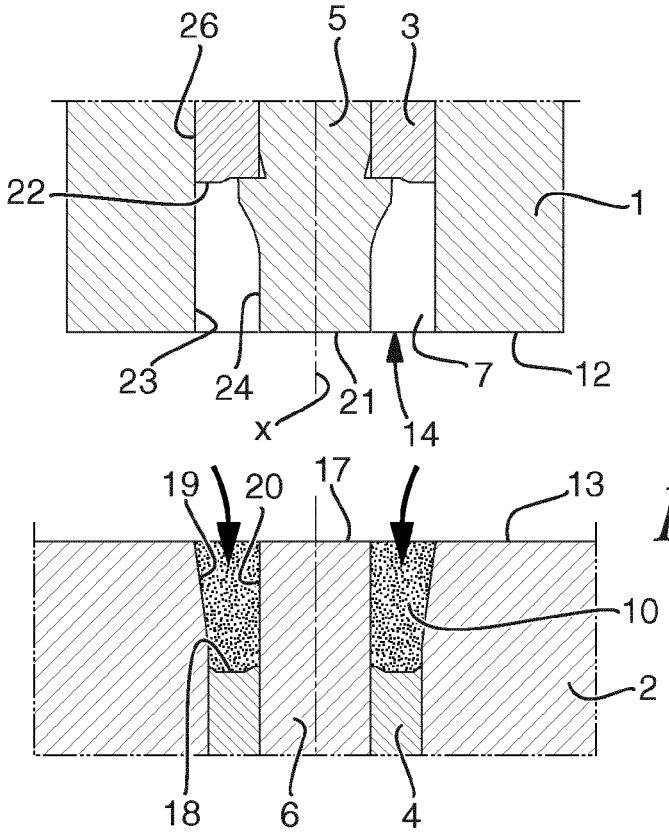
FIG. 2 is a corresponding cross section of the device shown in FIG. 1 as arranged during the filling step.
Figure 3:
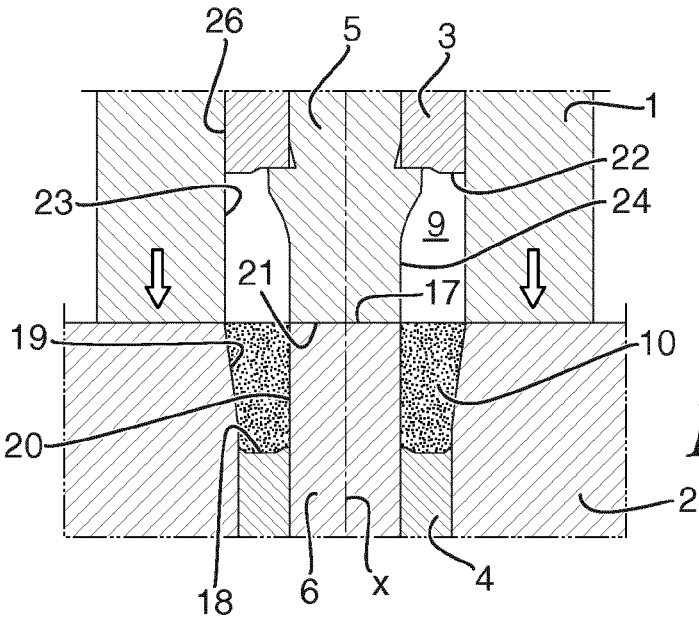
FIG. 3 is a corresponding cross section of the device shown in FIGS. 1 and 2 showing a step in which an upper die is joined with a lower die.
Figure 4:
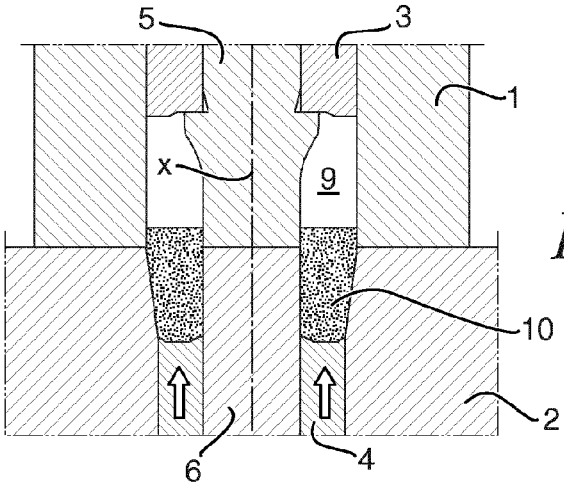
FIG. 4 is a corresponding cross section of the device shown in FIGS. 1-3 during an initial stage of a pressing step during which the powder introduced into the die cavity is to be compressed.
Figure 5:
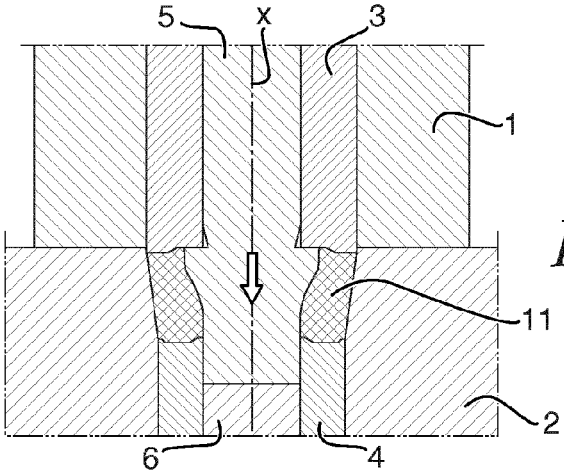
FIG. 5 is a corresponding cross section of the device shown in FIGS. 1-4 during a subsequent stage of said pressing step.

When joined, the upper and lower dies 1, 2, or more precisely the punch tunnels 7, 8 thereof, define a die cavity 9 arranged to accommodate a powder, indicated with 10 in FIGS. 2-4, which is compacted to a cutting insert green body, indicated with 11 in FIG. 5, by the action of the upper and lower punches 3, 4 during a pressing step in which at least one of the punches 3, 4 is moved towards the opposite punch 4, 3 in its respective punch tunnel 7, 8.

Figure 7:
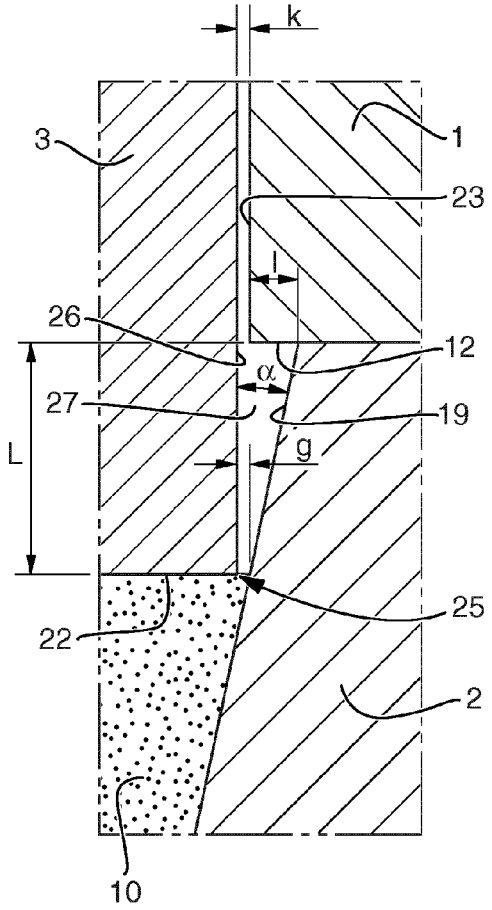
FIG. 7 is a cross section showing a detail of the device as arranged during the pressing step shown in FIG. 5.

The upper die 1 comprises a lower peripheral surface 12 arranged to abut and be supported by a corresponding upper peripheral surface 13 of the lower die 2 when the two dies are joined. The punch tunnel 7 of the upper die 1 presents an opening 14 in the lower peripheral surface 12 of the upper die 1. The punch tunnel 8 of the lower die 2 presents an opening 15 in the upper peripheral surface 13 of the lower die 2. The opening 14 of the upper die 1 is slightly smaller than the opening 15 of the lower die 2. When the dies 1, 2 are joined, and arranged for the pressing step in which the powder in the die cavity 9 is to be compressed, the opening 14 of the upper die 1 is in alignment with and opposite to the opening 15 of the lower die 2. Due to the difference in size between the openings 14, 15, the upper die 1 will overlap the opening 15 of the lower die 2. Preferably, the overlap, indicated with l in FIG. 7, is generally constant along the circumference of the opening 15 of the lower die 2. It is assumed, and preferred, that the opening 14 of the upper die 1 has a shape corresponding to the shape of the opening 15 of the lower die 2. However, there may be alternative embodiments in which a punch edge (to be described later) of the upper punch 3 has a non-linear shape, such as a wave-like shape, whereby the l will be permitted to vary and there will be a slight difference in shape between the opening 14 of the upper die 1 and the opening 15 of the lower die 2.

In the following the essential steps of the process in which a cutting insert green body 11 is produced by means of the device according to the invention will be described.

FIG. 2 shows a filling step in which the upper die 1, upper punch 3 and the upper core pin 5 are distanced from the lower die 2, the lower punch 4 and the lower core pin 6. The lower core pin 6 is forwarded in a vertical direction to a position in which an upper abutment surface 17 thereof is in alignment with the upper peripheral surface 13 of the lower die 2. The lower punch 4 is provided in a vertically retracted position in the punch tunnel 8 of the lower die 2. Thereby an open cavity that will form part of the die cavity 9 mentioned earlier is defined by an upper abutment surface 18 of the lower punch 4, an inner peripheral surface 19 of the lower die 2 that also defines at least part of the punch tunnel 8 of the lower die 2, and an outer peripheral surface 20 of the lower core pin 6. A powder 10 is introduced into the above-mentioned open cavity in the lower die 2.

In a subsequent step shown in FIG. 3 the upper die 1 is joined with the lower die 2, in this embodiment by means of a vertical motion of the upper die 1 such that it lands on the lower die 2. The opening 14 of the upper die 1 is in the above-mentioned position relative the opening 15, in which a rim of the upper die 1 will overlap the opening 15 of the lower die 2 along the circumference of the latter. The upper punch 3, together with the upper core pin 5, is forwarded to a position in which a lower abutment surface 21 of the upper core pin 5 abuts the upper abutment surface 17 of the lower core pin 6. A closed die cavity 9 is now defined by a lower abutment surface 22 of the upper punch 3, an inner peripheral surface 23 of the upper die 1 that also defines at least part of the punch tunnel 7 of the upper die, an outer peripheral surface 24 of the upper core pin 5 and the surfaces that, with reference to FIG. 2, defined the above-mentioned open cavity.

In a further subsequent step, shown in FIG. 4, the lower punch 4 is forwarded towards the upper punch 3 such that the powder 10 is lifted in the cavity 9 towards the upper punch 3. Thereby, a desired distribution of the powder is achieved.

Subsequently, as shown in FIG. 5, the upper punch 3 is forwarded towards the lower punch 4. Since, in this embodiment, the upper core pin 5 is fixed to the upper punch 3, the upper core pin 5 and the lower core pin 6 are also moved together with the motion of the upper punch 3, in the same direction and to the same extent as the latter. The upper punch 3 is forwarded to a predetermined level in the cavity 9 such that the powder 10 is compacted into a green body 11.

The upper punch 3 presents a punch edge 25 (see FIGS. 1 and 7) at an intersection between the abutment surface 22 and an outer peripheral surface 26 of the upper punch 3, and, as will be further discussed in the following presentation of the invention, the upper punch 3 is forwarded such a distance L (see FIG. 7) into the lower die 2 that there is a remaining gap g (see FIG. 7) between said inner peripheral surface 19 of the lower die and said punch edge 25. As can be seen in FIGS. 5 and 7, the position of the upper die 1 relative the lower die 2, and the position of the forwarded upper punch 3, is such that the whole green body 11 will be received by the lower die 2 as the powder 10 is compacted.

Figure 6:
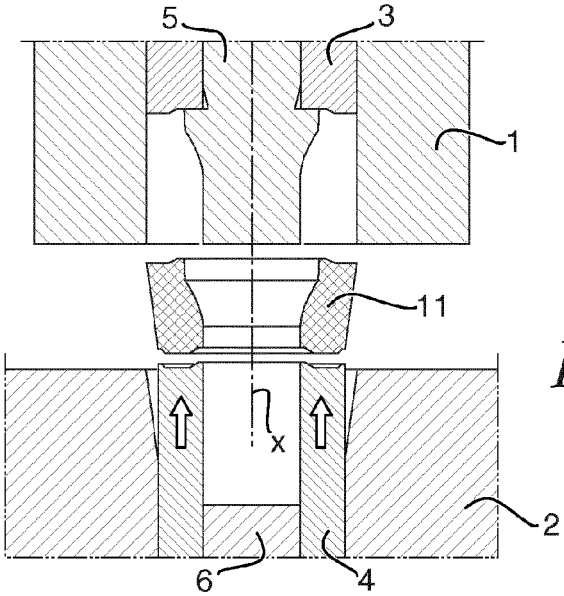
FIG. 6 is a corresponding cross section of the device shown in FIGS. 1-5 in connection to ejection of a green body formed during the foregoing pressing step.

After compaction of the powder 10 into the green body 11 shown in FIG. 5 the method of the invention includes the steps of displacing the upper die 1 relative the opening 15 of the lower die 2, thereby providing for more space for the green body 11 to exit through, and removing the upper punch 3 from the lower die 2, and moving the green body 11 out of the lower die 2 through said opening 15 of the lower die 2. These steps are indicated in FIG. 6. In embodiments that, like the one presented here, comprises an upper core pin 5 connected to the upper punch 3, the upper core pin 5 is also removed from the lower die 2 together with the upper punch 3. Since the upper punch 3, the lower die 2 and the upper die 1 can be designed such that the latter will be at a very short distance from the level to which the punch edge 25 of the upper punch 3 is forwarded during compaction, and the upper die 1 is displaced from the lower die 2 before the green body 11 is ejected from the latter, a very small release portion on the inner peripheral surface 19 of the lower die 2 will be needed above said level. As has already been explained, the formation of a residual edge on the green body 11 by powder that has escaped into such a release portion during the pressing step is thereby suppressed.

FIG. 7 is a detailed representation of the region in which the abutment surface 22 of the upper punch 3 abuts the powder 10 during pressing thereof, at the level to which the upper punch 3 is maximally forwarded into the lower die 2. The upper punch 3, and more precisely the punch edge 25 thereof, is forwarded a predetermined distance L through the opening 15 of the lower die 2 and into the lower die 2, to the level at which it is maximally forwarded.

The die cavity 9 has a centre axis x (see FIGS. 1-6). The upper punch 3, the lower punch 4, and the upper and lower core pins 5, 6 also has x as their respective centre axis. Above the level to which the punch edge 25 of the upper punch 3 is maximally forwarded, the inner peripheral surface 19 of the lower die 2 has an inclination angle $\alpha$ relative said centre axis x such that an inner circumference of the inner peripheral surface 19 of the lower die 2 increases towards the opening 15 thereof. In this embodiment, the inner peripheral surface 19 of the lower die 2 has the same inclination angle $\alpha$ also in the region below said level, down to the level at which the abutment surface of the lower punch 4 is forwarded or positioned during the pressing step. It should be understood that the inclination angle may differ along the inner peripheral surface 19, but that, at least in the release portion, i.e. the part of said surface 19 above the level to which the punch edge 25 is forwarded, there should be such an angle in order to permit radial expansion of the green body as the latter is ejected through the opening 15 of the lower die 2. The inclination angle $\alpha$ is in the range of $2° \leq \alpha \leq 30°$, depending on shape and size of the green body to be formed.

As can be seen in FIG. 7, the upper punch 3 is only forwarded to such a level that there will be a remaining gap g between the punch edge 25 and the inner peripheral surface 19 of the lower die 2. Contact between the punch edge 25 and the inner peripheral surface 19 should be avoided. The gap g may differ around the circumference of the upper punch 3 but should not be larger than 30 μm in order to prevent the upcoming of an excessively large residual edge at the upper edge of the conceived green body 11 to be formed.

Figure 8:
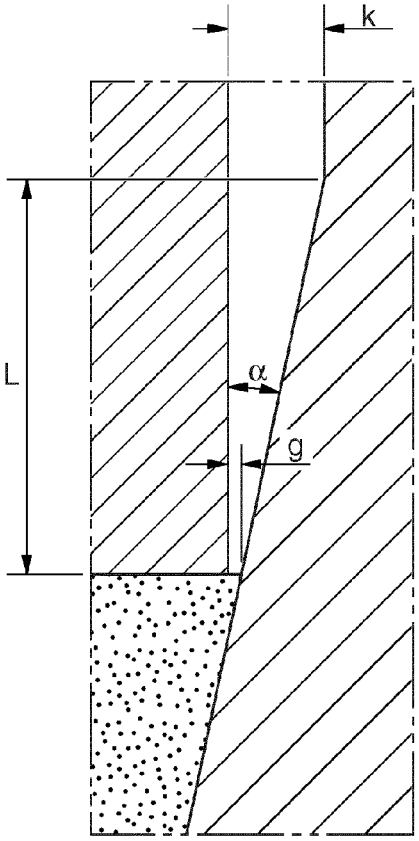
Fig 8 Prior Art
FIG. 8 is a corresponding cross section of prior art.

The opening 14 of the upper die 1 is smaller than the opening 15 of the lower die 2, but has a corresponding shape as the latter, which in its turn is dependent on the shape of the green body 11 to be formed and adapted to permit ejection of the whole green body 11 out of the lower die 2 through said opening 15 thereof. As a result thereof, a part of the lower peripheral surface 12 of the upper die 1 will overlap the opening 15 of the lower die 2. This overlap is indicated with l in FIG. 7, and forms a rim along the circumference of the opening 15 of the lower die 2. It should be understood that the size of the overlap l may differ along the circumference of the opening 15 of the lower die 2. The overlap l is dependent on the distance L that the upper punch 3 is forwarded into the lower die 2, and the inclination angle $\alpha$ of the inner peripheral surface 19 of the lower die 2. It is also dependent on the requisite that there should only be a very restricted gap k between the inner peripheral surface 23 of the upper die 1 and the outer peripheral surface 26 of the upper punch 3 in order to provide for accurate guiding of the upper punch 3 in the punch tunnel 7 defined by the inner peripheral surface 23 of the upper die 1 and to provide for prevention of leakage of powder into and through said gap k in connection to the pressing step during which the powder 10 in the die cavity 9 is compacted. Preferably, $k<10$ μm, and L should preferably be chosen such that $l+k \leq 20$ μm. Thereby, the space 27 defined by the outer peripheral surface 26 of the upper punch 3, the overlapping part of the lower peripheral surface 12 of the upper die 1 and the inner peripheral surface 19 of the lower die 2 can be very restricted, and will provide for formation of only a very small residual edge on the green body due to leakage of powder into said space 27 during the pressing step. This should be compared to the prior art, shown in FIG. 8, in which there is no subdivision of the die in an upper die and a lower die, and in which the only die has to provide for a sufficient release portion for an expanding green body when the latter is ejected in the direction of the upper punch. Prior art will therefore adopt a much larger gap k between the inner peripheral surface of the die and outer peripheral surface of the punch, and there will be much larger space for the powder to leak into during the pressing step. Thus, prior art will result in a larger residual edge on the green body than the device and method of the present invention will result in.

In the foregoing description of the present invention, the definitions "upper" and "lower" have been used for a number of components and surfaces thereof, and as a consequence thereof also the definition "vertical direction". However, it should be understood that these definitions have been made merely in order to facilitate the disclosure of the invention, when the device according to the invention is positioned in such a position in the room that these definitions are valid, as can be seen on the drawing. Other positioning of a correspondingly designed device is, of course, also within the claimed scope of protection. However, according to a preferred embodiment, this specific positioning of the device is preferred, since it will facilitate the whole set up of the device as well as certain method steps, in particular the filling of the powder into the die cavity.

The invention claimed is:

1. A method for manufacturing a cutting insert green body by compressing a powder, comprising the steps of providing a compression tool having an upper die and a lower die, an upper punch and a lower punch, wherein the upper die defines a punch tunnel in which the upper punch is arranged to slide, and the lower die defines a punch tunnel in which the lower punch is arranged to slide, and wherein the dies, when joined together define a die cavity provided to accommodate a powder to be compressed by action of the respective punches for the forming of said green body;

providing the lower punch in a predetermined position in the punch tunnel of the lower die;

filling powder into an open cavity defined in the lower die;

joining the upper and lower dies such that an opening of the upper die meets and communicates with a corresponding opening of the lower die and such that said cavity filled with powder in the lower die forms part of said die cavity;

compressing the powder in said die cavity by action of said punches, wherein said upper punch is forwarded through the punch tunnel of the upper die and is forwarded a predetermined distance L through said opening of the lower die and into the lower die, whereby said green body is formed;

displacing the upper die relative the opening of the lower die, thereby providing for more space for the green body to exit through; and removing the upper punch from the lower die, and moving the green body out of the lower die through said opening of the lower die, wherein the die cavity defined by the dies has a vertical centre axis and that, in the region of said opening of the lower die, an inner peripheral surface of the lower die has an inclination angle $\alpha$ relative to said centre axis such that an inner circumference of the inner peripheral surface of the lower die increases towards said opening thereof, wherein the upper punch presents an abutment surface for abutment against the powder, an outer peripheral surface, and a punch edge at an intersection between the abutment surface and the outer peripheral surface, wherein the upper punch is forwarded the distance L into the lower die such that there is a remaining gap g between said inner peripheral surface of the lower die and said punch edge, wherein $0\ \mu m<g\leq 30\ \mu m$, wherein the level of the punch edge will define an upper edge of the green body, and wherein the upper edge is formed where said inner peripheral surface intersects a plane of the abutment surface of the upper punch.

2. A method according to claim 1, wherein the opening of the upper die is smaller than the opening of the lower die, such that the upper die overlaps the opening of the lower die with a distance l when the dies are joined.

3. A method according to claim 2, wherein $l\leq 55\ \mu m$.

4. A method according to claim 1, wherein $L\geq 50\ \mu m$.

5. A method according to claim 1, wherein $2°\leq\alpha\leq 30°$.

6. A method according to claim 1, wherein in the region of the opening of the upper die, there is formed a gap k between an outer peripheral surface of the upper punch and an inner peripheral surface of the upper die, wherein $k<50\ \mu m$.

7. A method according to claim 1, wherein the green body is moved out of the lower die either by withdrawal of the lower die while the lower punch is maintained in its position, or by ejection of the lower punch through the lower die while the latter is maintained in its position, or a combination thereof.

8. A device for manufacturing a cutting insert green body by compressing a powder, said device comprising:

a compression tool including an upper die and a lower die, an upper punch and a lower punch, wherein the upper die defines a punch tunnel in which the upper punch is arranged to slide, and the lower die defines a punch tunnel in which the lower punch is arranged to slide, and wherein the dies, when joined, together define a die cavity provided to accommodate a powder to be compressed by action of the respective punches for the forming of said green body, the upper and lower dies each having a respective opening such that an opening of the upper die meets and communicates with a corresponding opening of the lower die when the upper and lower dies are joined, whereby the upper punch is arranged so as to be forwarded a predetermined distance L through said opening of the lower die and into the lower die upon compaction of the powder, and whereby the upper die is displaceable relative to the opening of the lower die, and being arranged so as to be displaced relative said opening of the lower die before removal of said green body through said opening of the lower die, thereby providing for more space for the green body to exit through, wherein the die cavity defined by the dies has a vertical centre axis and that, in the region of said opening of the lower die, an inner peripheral surface of the lower die has an inclination angle $\alpha$ relative to the centre axis such that an inner circumference of the inner peripheral surface of the lower die increases towards said opening thereof, wherein the upper punch presents an abutment surface for abutment against the powder, an outer peripheral surface, and a punch edge at an intersection between the abutment surface and the outer peripheral surface, and wherein the upper punch is arranged to be forwarded the distance L into the lower die such that there is a remaining gap g between said inner peripheral surface of the lower die and said punch edge, wherein $2°\leq\alpha\leq 30°$, wherein the level of the punch edge will define an upper edge of the green body, and wherein the upper edge is formed where said inner peripheral surface intersects a plane of the abutment surface of the upper punch.

9. A device according to claim 8, wherein the opening of the upper die is smaller than the opening of the lower die, such that the upper die overlaps the opening of the lower die with a distance/when the dies are joined.

10. A device according to claim 9, wherein $l\leq 55\ \mu m$.

11. A device according to claim 8, wherein $L\geq 50\ \mu m$.

12. A device according to claim 8, wherein in the region of the opening of the upper die, there is formed a gap k between an outer peripheral surface of the upper punch and an inner peripheral surface of the upper die, wherein $k<50\ \mu m$.

* * * * *